US012030678B2

(12) United States Patent
Senechal et al.

(10) Patent No.: US 12,030,678 B2
(45) Date of Patent: Jul. 9, 2024

(54) METHOD FOR PACKAGING PRODUCTS

(71) Applicant: BONDUELLE, Renescure (FR)

(72) Inventors: Sébastien Senechal, Renescure (FR); Christian Ducez, Renescure (FR); Laurent Dupont, Renescure (FR)

(73) Assignee: BONDUELLE, Renescure (FR)

( * ) Notice: Subject to any disclaimer, the term of this patent is extended or adjusted under 35 U.S.C. 154(b) by 308 days.

(21) Appl. No.: 17/434,129

(22) PCT Filed: Feb. 28, 2020

(86) PCT No.: PCT/FR2020/050403
§ 371 (c)(1),
(2) Date: Aug. 26, 2021

(87) PCT Pub. No.: WO2020/174202
PCT Pub. Date: Sep. 3, 2020

(65) Prior Publication Data

US 2022/0144464 A1 May 12, 2022

(30) Foreign Application Priority Data

Feb. 28, 2019 (FR) ..... 19 02077

(51) Int. Cl.
*B65B 25/04* (2006.01)
*B65B 31/02* (2006.01)
*B65D 81/20* (2006.01)

(52) U.S. Cl.
CPC ..... *B65B 25/041* (2013.01); *B65B 31/02* (2013.01); *B65D 81/2046* (2013.01)

(58) Field of Classification Search
CPC ..... B65B 25/041; B65B 31/02; B65B 31/022; B65B 31/028; B65D 81/2046
(Continued)

(56) References Cited

U.S. PATENT DOCUMENTS 4,933,411 A * 6/1990 Gifford ..... A23B 7/06 426/399
5,682,723 A 11/1997 Nowotarski et al.
(Continued)

FOREIGN PATENT DOCUMENTS

CZ 289575 B6 * 2/2002 ..... B65B 31/006
DE 202004020529 U1 9/2005
(Continued)

OTHER PUBLICATIONS

"There's Space between molecules" by Flinn, retrieved from URL https://www.flinnsci.ca/api/library/Download/cc9fb87590c3497cb3ea93038fea5703 on Sep. 20, 2023 (Year: 2016).*
(Continued)

*Primary Examiner* — Valentin Neacsu
(74) *Attorney, Agent, or Firm* — Maier & Maier, PLLC

(57) ABSTRACT

A method for packaging products, in particular oxygen-sensitive ones, in containers, each of the containers having an opening. The set-up of the controlled atmosphere is carried out in a transfer cabinet inside which the open containers progress in the direction of the closure cabinet, by the following combined actions: an action a) of injecting a process gas flow into the closure cabinet downstream of the transfer cabinet according to the progress direction of the open containers, and an action b) of vacuumising the open containers present inside the transfer cabinet.

16 Claims, 4 Drawing Sheets

(58) Field of Classification Search
USPC ..... 53/79, 432, 510, 88
See application file for complete search history.

(56) References Cited

U.S. PATENT DOCUMENTS

| | | | | |
|---|---|---|---|---|
| 5,916,110 | A * | 6/1999 | Sanfilippo | B65B 31/00 53/511 |
| 6,032,438 | A * | 3/2000 | Sanfilippo | B65B 31/00 141/70 |
| 6,305,149 | B1 * | 10/2001 | Gorlich | B26F 3/08 83/16 |
| 6,457,299 | B1 * | 10/2002 | Schwenke | B67C 7/0073 53/167 |
| 6,470,795 | B1 * | 10/2002 | Brown | B65B 31/024 99/473 |
| 9,227,747 | B2 | 1/2016 | Dupont et al. | |
| 2006/0159809 | A1 * | 7/2006 | Goktepe | A23B 7/148 426/118 |
| 2012/0308699 | A1 * | 12/2012 | Dupont | B65B 31/025 53/266.1 |
| 2012/0312824 | A1 * | 12/2012 | Dathy | B65D 79/0081 220/660 |
| 2014/0013704 | A1 * | 1/2014 | Hubner | B65B 41/12 53/79 |
| 2014/0208692 | A1 | 7/2014 | Leturmy et al. | |

FOREIGN PATENT DOCUMENTS

| | | | |
|---|---|---|---|
| EP | 0761541 | A1 | 3/1997 |
| EP | 0806354 | A1 | 11/1997 |
| FR | 2960858 | A1 | 12/2011 |
| FR | 2964949 | A1 | 3/2012 |
| FR | 2979327 | A1 | 3/2013 |
| WO | 9531375 | A1 | 11/1995 |
| WO | 2011/077034 | A1 | 6/2011 |

OTHER PUBLICATIONS

Definition of Vacuum, by Merriam-Webster, retrieved from URL https://www.merriam-webster.com/dictionary/vacuum on Sep. 20, 2023 (Year: 2023).*

International Search Report issued on Jul. 3, 2020 in corresponding application No. PCT/FR2020/050403; 9 pgs.

* cited by examiner

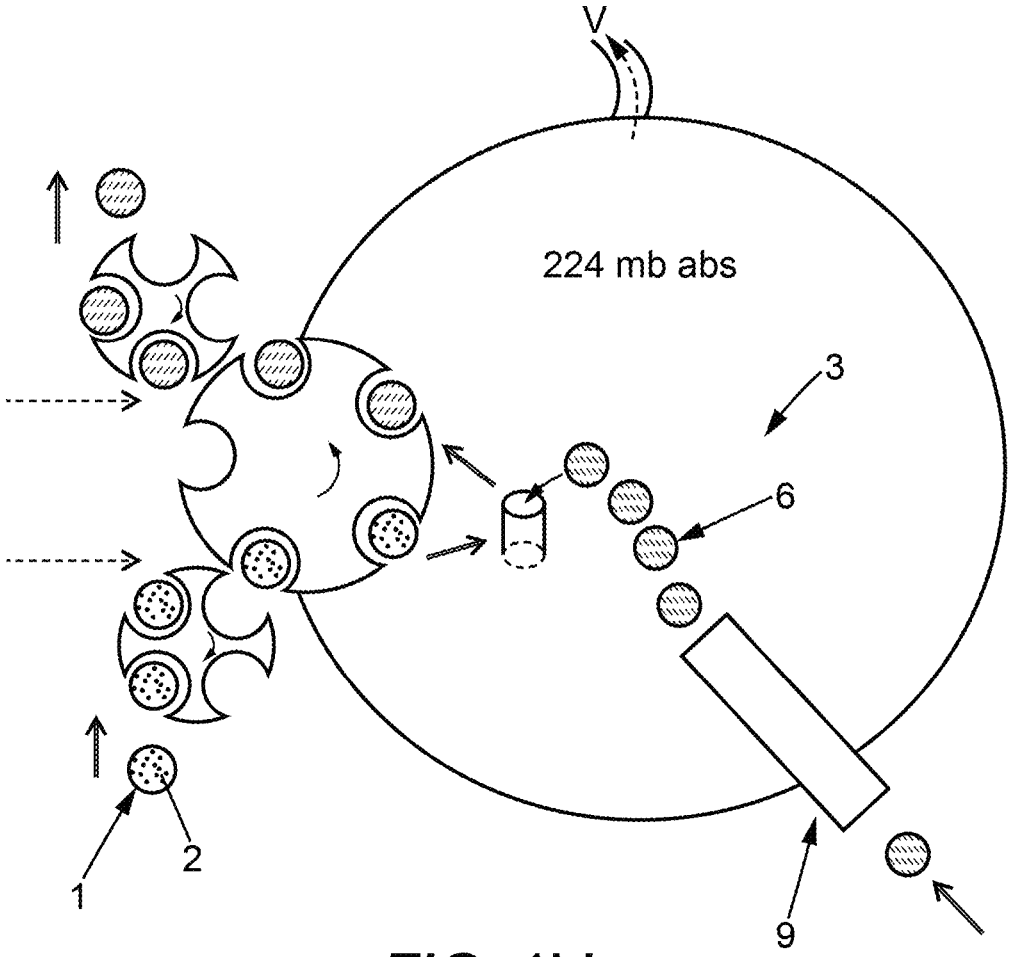
FIG. 1bis
(PRIOR ART)

METHOD FOR PACKAGING PRODUCTS

FIELD

The invention relates to a method for packaging products, in particular oxygen-sensitive ones, in containers, as well as a packaging plant adapted for the implementation of the method.

The invention finds a particular application in packaging food products in a liquid state, or in a pasty state, or in a solid state or products in these different states. The invention also finds a particularly advantageous and non-limiting application for solid products, when interstitial air between the products in the product bed is to be expelled, with a non-negligible porosity, and more particularly for packaging corn, peas, mushrooms, or carrots (in a little bit of juice).

The invention also relates to a method for obtaining a packaging plant according to the invention starting from an existing vacuum container closure plant, well known from the state of the art in the food industry, hereinafter referred to as vacuum seamer.

The invention also relates to an (unsterilised) container obtained according to the packaging method in accordance with the invention, but also a sterilised container when the method comprises a sterilisation step, carried out in a continuous or discontinuous manner.

These containers are remarkable in that they have a low residual oxygen, while the (solid) product bed has a (non-negligible) porosity, the containers being in overpressure with respect to the atmospheric pressure at room temperature (20° C.).

The field of the invention is that of methods used to reduce the amount of oxygen present in a container, and in particular at the head space, namely the space above the products, and before the tight closure of the latter, and/or at the interstitial spaces between the products, beneath the head space.

The reduction of the amount of oxygen allows reducing the phenomena of oxidation of the products contained inside the container, and/or of the development of unpleasant tastes/odours, and/or of alteration of the colour of the products.

BACKGROUND

A first technique for reducing the contained oxygen, widespread in the food industry, consists in vacuumising the container upon tight closure thereof. The reduction of the amount of oxygen obtained after the crimping step is done by reduction of the residual air volume, by the action of the vacuum.

Thus, a plant for closing a container by crimping, under vacuum, hereinafter referred to as vacuum seamer, is known from the state of the art in the food industry, which allows crimping a cap on a tin can filled beforehand with food products. To this end, a vacuum seamer comprises:

- a gas-tight cabinet, called crimping cabinet,
- a closure system configured so as to close the upper opening of each container, inside said crimping cabinet by the adding a cap and crimping the cap to the container,
- a transfer cabinet, partially tight, quite often in the form of a tunnel, opening into the crimping cabinet, receiving a conveyor, ensuring the entry of the open containers into the crimping cabinet, upstream of the closure system, and the exit of the closed containers downstream of the crimping cabinet,

- a system for introducing caps, partially tight, quite often in the form of a vertical well opening into the crimping cabinet ensuring dispensing and set-up of said caps before the crimping step,
- a vacuum and regulation source connected to said crimping cabinet.

In a notable manner, said transfer cabinet has a timing and air-lock functions: it comprises to this end movable shutters allowing limiting the inlet of air from the entrance of the transfer cabinet for the open containers towards the exit of the transfer cabinet which opens into the vacuumised crimping cabinet.

The amount of oxygen in the crimping cabinet is reduced by a vacuum in the range of 800 millibars below the atmospheric pressure, namely 224 millibars absolute. Throughout the present application, and by convention, the atmospheric pressure has been considered equal to 1024 millibars absolute. Next, all mentioned pressures will be expressed in millibars absolute.

A first drawback of such a method is that it allows reducing the concentration of oxygen in the container, down to a non-negligible minimum level of 4.5% of oxygen in volume after closure.

A second drawback of such a method is that it is compatible only with containers whose walls must withstand a pressure difference between the inside and the outside of the container, once closed.

Indeed, when the closed container is subjected again to the atmospheric pressure, the pressure difference between the inside of the container, at a pressure well below the atmospheric pressure and the atmosphere outside the container, at the atmospheric pressure, requires tin cans whose wall thickness is sufficient for not deforming and collapsing under the pressure difference. Such a phenomenon is marked upon sterilisation of the containers during which the containers might be subjected to pressures substantially higher than the atmospheric pressure.

A third drawback of such a method is that it considerably limits the temperatures of the products upon encasement, the vacuum causing a lowering of the boiling temperature, which might cause an evaporation of the liquids by boiling inside the cans.

A second technique for reducing the contained oxygen consists in sweeping the head space of the container with a neutral inerting gas, such as nitrogen or carbon dioxide.

The documents WO9531375, EP 0761541, EP0806354, FR 2960858, and FR2979327 are typical examples. In such methods, air is expelled from the head space by subjecting this head space to a neutral gas stream. Such methods are satisfactory when the air to be expelled is essentially contained in the head space of the container, namely the space above the products.

However, and in the case of solid products, a considerable amount of air may be contained, not only in the head space (above the products), but also at the interstices between the products (beneath the head space). In this case, a brief sweep of the head space by a neutral gas allows replacing essentially the air of the head space, and not the interstitial air. With such a method, expelling the interstitial air requires long stay times under sweeping. Hence, these methods are merely effective when the interstitial air inside the container is present in a non-negligible amount. Such a method involving mere sweeping does not allow lowering the amount of oxygen below 4.5% in volume with respect to the total volume of contained gas (in the head volume and the interstitial spaces) when the product bed has a non-negligible porosity.

A third technique, having been the object of the document FR2964949 A1 of the present Applicant consists in expelling the air of the container by backfilling of the container with a liquid, and then placing the backfilled container in a cabinet under a non-oxidising controlled atmosphere, and totally or partially emptying the liquid off the container, under a non-oxidising atmosphere while holding said products in said container so that said non-oxidising gas replaces said liquid in said container.

Such an inerting method is particularly effective in terms of oxygen suppression as it allows suppressing quite effectively not only the air contained in the head space, but also the interstitial air. With this technique, it is possible to reduce the residual air to very small amounts, in contrast with the two aforementioned techniques. However, the implementation of such a method requires an appropriate equipment, relatively expensive, to ensure backfilling of the containers, and then emptying of the containers in the cabinet under a controlled atmosphere.

Still a fourth known technique consists in injecting liquid nitrogen, just before its closure at the head space. The difficulty in implementing such a method lies essentially in the proper dosage of the nitrogen drop, as well as in the timing of the closure step.

For example, an overdose of the nitrogen drop, or a too early closure of the container, could result in a high pressure inside the container, weakening, or deteriorating the container. On the contrary, if the closure step is too late, air will get in again at said head space and the packaging will be defective.

A drawback of such an inerting method which relies only on the addition of liquid nitrogen before closure is that it essentially allows expelling the air present at the head space, but is not satisfactory in terms of residual oxygen performance when the container comprises interstitial air between the products in a non-negligible amount. The document WO 2011/077034 is an example of such a tin can wherein the internal pressure is higher than the atmospheric pressure because of the (mere) addition of liquid nitrogen. As such, the mere addition of liquid nitrogen does not allow obtaining good performances in terms of residual oxygen when the contained products have a non-negligible porosity, namely interstitial air to be expelled in the product bed. Such a liquid nitrogen addition technique does not allow properly preserving solid products with a non-negligible porosity, namely featuring interstitial spaces in a non-negligible amount in the product bed, with an oxygen level lower than 4.5% in volume with respect to the total volume of contained gas (in the head volume and the interstitial spaces). Hence, this technique is not suitable for the preservation of products such as corn, peas, mushrooms, or carrots (in a little bit of juice).

These known solutions do not allow obtaining very good performances in terms of oxygen reduction inside the containers, namely lower than 4.5% of residual oxygen in volume with respect to the total volume of contained gas (in the head volume and in the interstitial spaces), even when the interstitial air to be expelled is in a non-negligible amount between the contained products, with high production rates, and with a controlled investment.

The invention is intended to improve the situation.

SUMMARY

The present invention aims to provide a continuous packaging method that overcomes the aforementioned drawbacks by allowing for very good performances in terms of oxygen reduction inside the containers, even when the interstitial air to be expelled is in a non-negligible amount between the contained products and without modifying the nominal production rate as known for vacuum seamers.

More particularly, the method according to the invention could allow reaching very good performances in terms of oxygen reduction inside the containers in a range from 4.5% to 0.2% of oxygen in volume with respect to the total volume of contained gas (in the head volume and the interstitial spaces), strictly lower than 4.5% for example between 3% and 0.2% or between 2% and 0.2%, or between 1% and 0.2% of oxygen, while maintaining high production rates, higher than 100 strokes per minute, in particular higher than 300 strokes per minute such as 600 strokes per minute or more, and even in the presence of interstitial air to be expelled between the contained products.

The present invention also aims to provide, at least according to one embodiment, a method that could be implemented using a vacuum seamer as known from the state of the art, after slight modifications of this equipment, and therefore at a lesser cost when this equipment already exists on the production site.

The present invention also aims to provide, at least according to one embodiment, a method that could be implemented, without restriction on the container type, namely rigid containers such as tin cans, even with a small wall thickness, jars made of glass or plastic, and even flexible containers.

The present invention also aims to provide a container obtained according to the packaging method, having a low residual air ratio, even in the presence of interstitial spaces between the products, which enables the implementation of an optimised sterilisation.

Other objects and advantages of the present invention will appear throughout the description which is given only for indicative purposes and which does not intend to limit it.

First of all, the invention relates to a method for packaging products, in particular oxygen-sensitive ones, in containers, each of said containers having an opening, said method comprising the following steps:

- the container is partially filled with the products,
- the upper portion of the containers is put in contact with a process gaseous atmosphere, in order to evacuate all or part of the air present in the container and to set up the required controlled atmosphere,
- it is proceeded with the closure of the container, hereinafter referred to as the closure step, in a closure cabinet,
- the set-up of the controlled atmosphere being carried out upstream of and/or during the closure step.

According to the invention, the set-up of the controlled atmosphere is carried out in a transfer cabinet inside which the open containers progress in the direction of the closure cabinet, by the following combined actions:

- an action a) of injecting a process gas flow into said closure cabinet downstream of the transfer cabinet according to the progress direction of the open containers,
- an action b) of vacuumising the open containers present inside the transfer cabinet and so as to evacuate the air present in the open containers and to reduce the concentration of oxygen in the containers by the combined actions of the vacuum created in said transfer cabinet and the replacement of the evacuated air with the process gas flowing in countercurrent with the open containers in said transfer cabinet, and by the effect of dilution of the air oxygen with the process gas.

The method may also comprise the following optional features, considered separately or in combination:

said action a) of injecting a process gas flow further comprises, in addition to the injection of a gaseous stream, the injection of an amount of liquefied gas, with the vaporisation (at least partially) of the liquefied gas after closure of the container so as to increase the pressure inside the container above the pressure prevailing in the closure cabinet;

the pressure P prevailing inside the closure cabinet may be higher than the atmospheric pressure Po comprised between 1024 millibars absolute and 1224 millibars absolute, for example between 1024 millibars absolute and 1074 millibars absolute, and else for example, between 1024 millibars absolute and 1054 millibars absolute;

the vacuum created in the transfer cabinet is comprised between 600 millibars absolute and 900 millibars absolute, in particular between 700 millibars and 900 millibars;

the flow rate of gas injection into the closure cabinet is comprised between 100 $m^3/h$ and 500 $m^3/h$, and for example between 200 $m^3/h$ and 300 $m^3/h$;

the progress of the open containers in said transfer cabinet is ensured by a conveyor with an air-lock function, which comprises shutters;

the container features interstitial spaces between the products filled with the process gas, once the container is closed; the interstitial space ratio in the product bed filled with the process gas, called porosity degree, may be comprised between 20% and 60%, for example between 30% and 40%;

the container features a head space between the products and the upper portion of the container filled with the process gas, once the container is closed;

the action b) of vacuumising the open containers present inside the transfer cabinet is carried out by sucking in the atmosphere inside said transfer cabinet at several suction areas distributed along said transfer cabinet;

the action b) is carried out by means of a vacuumised dispensing and regulation chamber, as well as by a plurality of suction pipes, parallel to one another joining the dispensing chamber to said suction areas distributed along said transfer cabinet;

the process gas is nitrogen, or $CO_2$;

the products consist of food products.

According to one embodiment, the containers consist of metallic tin cans, closure of the containers essentially consisting in adding caps and crimping the caps to the containers.

According to another variant, the containers consist of flexible containers. In such a case, the closure may be achieved by pinching the walls of the opening, and by the application of a weld between the pinched walls.

According to still another variant, the containers may consist of rigid containers made of plastic or of jar-type glass. The closure may be achieved by means of a cap or by the set-up of an equivalent means such as a plug.

Advantageously, the method allows obtaining the following features, considered separately or in combination:

the obtainment of (closed) containers in overpressure with respect to the atmospheric pressure. According to one embodiment, the pressure inside the containers may be higher, yet close to the atmospheric pressure namely higher than 1024 millibars absolute at 20° C. comprised between 1024 millibars absolute and 1224 millibars absolute, once closed. In such a case, upon closure, the pressure inside the containers is substantially equal or close to the pressure prevailing in the closure cabinet, which is higher than or close to the atmospheric pressure. Such an internal pressure is obtained when the packaging method does not provide for the injection of liquefied gas at the action a). When the method provides for the injection of an amount of liquefied gas at said action a), the pressure inside the closed containers is substantially higher than the pressure prevailing in the closure cabinet and may thus be considerably higher than the atmospheric pressure, namely in particular higher than 1424 millibars absolute, a small (residual) amount of oxygen in the closed container, comprised between 4.5% and 0.2% of oxygen in volume with respect to the total volume of contained gas (in the head volume and the interstitial spaces), strictly lower than 4.5% for example between 3% and 0.2%, for example between 2% and 0.2% such as between 1% and 0.2% of oxygen, and even in the presence of interstitial air to be expelled between the products: the ratio of interstitial spaces in the product bed filled with the process gas, called porosity degree may be comprised between 20% and 60%, for example between 30% and 40%, a production rate higher than 100 strokes per minute, or 300 strokes per minute, or higher than or equal to 600 strokes per minute.

The invention also relates to a (non-sterilised) container containing oxygen-sensitive products obtained by the method according to the invention, the product bed has interstitial spaces filled with the process gas and wherein the amount of (residual) oxygen in the container is comprised between 4.5% and 0.2% of oxygen in volume with respect to the total volume of gas contained in the head space and the interstitial spaces, strictly lower than 4.5% in volume, for example comprised between 3% and 0.2%, or between 2% and 0.2% and even between 1% and 0.2%, and the pressure inside the container is overpressurised with respect to the atmospheric pressure, higher than 1024 millibars absolute at 20° C. The interstitial space ratio in the product bed filled with the process gas, called porosity degree, is non-negligible, in particular comprised between 20% and 60%, for example between 30% and 40%.

According to one embodiment, the pressure inside the container may be comprised between 1024 and 1224 millibars absolute, in particular comprised between 1075 millibars absolute and 1224 millibars absolute, such as 1075 millibars absolute when the method does not include a liquefied gas injection at the action a). The pressure inside the unsterilised container may be higher than 1424 millibars absolute in case of liquefied gas injection.

These residual oxygen and pressure performances may be achieved for the (unsterilised) container even in case of presence of interstitial spaces between the products filled with the process gas: the interstitial space ratio in the product bed filled with the process gas, called porosity degree may be comprised between 20% and 60%, for example between 30% and 40%. The products may consist of corn (in a little bit of juice) with the presence of interstitial spaces filled with said process gas between the corn grains. The products may also consist of peas, or mushrooms, or carrots in a little bit of juice.

The invention also relates to a packaging method in accordance with the invention, wherein the container is subjected after closure to a step of sterilisation by heat treatment at a temperature higher than 100° C., such as between 110° C. and 130° C.

The invention also relates to a sterilised container obtained according to the packaging (and sterilisation by heat treatment) method, wherein the product bed has interstitial spaces filled with the process gas, and wherein the amount of oxygen in the container is comprised between 4.5% and 0.2% of oxygen in volume with respect to the total volume of gas contained in the head space and the interstitial spaces, strictly lower than 4.5%, in particular comprised between 3% and 0.2%, or between 2% and 0.2%, or between 1% and 0.2%, and wherein the pressure inside the container is overpressurised with respect to the atmospheric pressure, higher than 1024 millibars absolute. The internal pressure may be comprised between 1024 millibars absolute and 1424 millibars absolute at 20° C., or between 1024 millibars absolute and 1224 millibars absolute, in particular when the method does not include a liquefied gas injection at the action a). The pressure inside the sterilised container may also be higher than 1424 millibars absolute in case of liquefied gas injection at said action a), substantially higher than the pressure prevailing in the closure cabinet.

The interstitial space ratio in the product bed filled with the process gas, called porosity degree, may be comprised between 20% and 60%, for example between 30% and 40%.

According to an embodiment of the sterilised container, the products consist of corn with the presence of interstices between the corn grains filled with the process gas, the pressure inside the container being comprised between 1124 millibars absolute and 1424 millibars absolute at 20° C., or between 1124 millibars absolute and 1224 millibars absolute, in particular 1194 millibars absolute. The products may also consist of peas, mushrooms or carrots (in a little bit of juice).

The invention also relates to a packaging plant adapted for the implementation of the method according to the invention, comprising:

- a gas-tight cabinet, called closure cabinet,
- a closure system configured so as to close the upper opening of each container, inside said closure cabinet,
- a partially tight transfer cabinet, opening into the closure cabinet, receiving a conveyor with an air-lock function, ensuring the entry of the open containers into the closure cabinet, upstream of the closure system and the exit of the closed containers downstream of the closure cabinet, said conveyor with an air-lock function comprising movable shutters,
- possibly, a conveyor for bringing in the caps enabling transfer from the atmospheric pressure (outside the closure cabinet) up to the inside of the closure cabinet,
- a source of an oxygen-free process gas, such as nitrogen, and a system for injecting said process gas into the closure cabinet,
- a vacuum source, connected to a dispensing and vacuum regulation chamber, as well as a plurality of suction pipes joining the dispensing and regulation chamber to said suction areas distributed along said transfer cabinet and so as to evacuate all or part of the air present in the open containers and to reduce the concentration of oxygen in the containers by the combined actions of the vacuum created in said transfer cabinet and the replacement of the evacuated air with the process gas flowing in countercurrent with the open containers in said transfer cabinet, and by the effect of dilution of the air oxygen with the process gas.

Finally, the invention relates to a method for obtaining a plant according to the invention from an existing plant for closing containers, under vacuum, in particular a vacuum seamer, hereinafter referred to as vacuum seamer, comprising:

- a gas-tight cabinet, called closure cabinet,
- a closure system configured so as to close the upper opening of each container, inside said closure cabinet,
- a partially tight transfer cabinet, opening into said closure cabinet, receiving a conveyor with an air-lock function, ensuring the entry of the open containers into the closure cabinet, upstream of the closure system and the exit of the closed containers downstream of the closure cabinet, said conveyor with an air-lock function comprising movable shutters,
- a conveyor for bringing in the caps enabling transfer from the atmospheric pressure (outside the closure cabinet) up to the inside of the closure cabinet,
- a vacuum source connected to said closure cabinet, in which method said packaging plant according to the invention is obtained by modifying said vacuum closure plant in the following manner:
- addition of a dispensing and vacuum regulation chamber, as well as a plurality of suction pipes joining the dispensing chamber to said suction areas distributed along said transfer cabinet, while disconnecting the vacuum source from said closure cabinet and while connecting said vacuum source to said dispensing and regulation chamber,
- addition of a source of an oxygen-free process gas and connecting it to said closure cabinet.

BRIEF DESCRIPTION OF THE DRAWINGS

Other features, details and advantages will appear upon reading the detailed description hereinafter, and analysing the appended drawings, wherein:

FIG. 1*bis* is a schematic top view of a vacuum crimping plant, as known from the state of the art, commonly called vacuum seamer with a rotary feed-in conveyor.

DETAILED DESCRIPTION OF THE EMBODIMENTS

Figure 1:
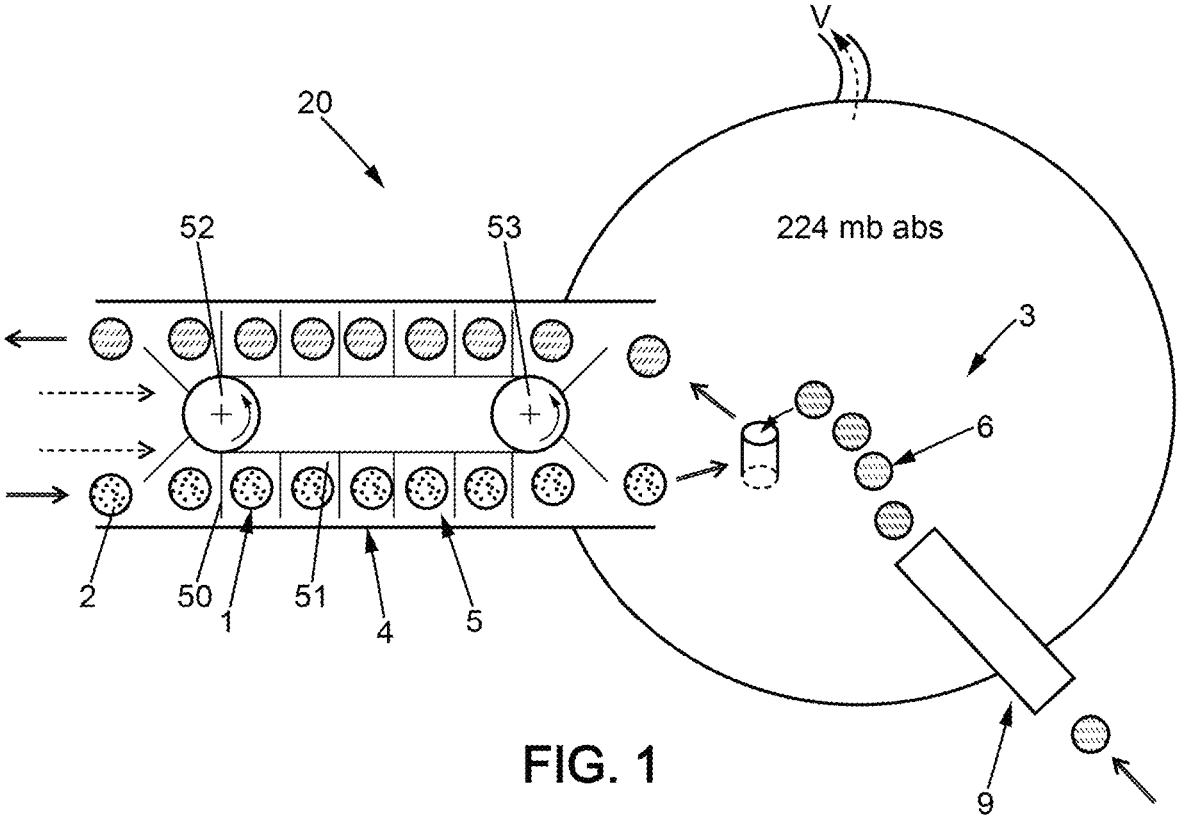
FIG. 1 (PRIOR ART)
FIG. 1 is a schematic top view of a vacuum crimping plant, as known from the state of the art, commonly called vacuum seamer with a linear feed-in conveyor.

The drawings and the description hereinafter essentially contain elements with a certain nature. Hence, they might not only serve to better set out the present invention, but also to contribute to its definition, where appropriate.

Also, the invention primarily relates to a method for packaging products, in particular oxygen-sensitive ones, in containers 1.

The products may consist of (solid) food products, for example, vegetables, cereals, meat, fish, or others, alone or mixed, with or without juice. For example, the invention finds a particular application when there is interstitial air in a non-negligible amount between the products, for example for products with a little bit of juice: thus the invention finds a particular application for packaging corn in a little bit of juice with the presence of interstices in the container between the corn grains.

Each of the containers has an upper opening, enabling filling of the container with the products.

The product packaging method comprises the following steps:

- the container 1 is partially filled with the products 2,
- the upper portion of the containers is put in contact with a process gaseous atmosphere, in order to evacuate all or part of the air present in the container and to set up the required controlled atmosphere,
- it is proceeded with the closure of the opening of the container, herein after referred to as the closure step, in a tight closure cabinet 3,
- the set-up of the controlled atmosphere being carried out upstream of and/or during the closure step.

In a notable manner, and according to the invention, the set-up of the controlled atmosphere is carried out in a transfer cabinet, partially tight inside which the open containers progress in the direction of the closure cabinet 3, by the following combined actions:

- an action a) of injecting a process gas G flow and possibly of injecting a liquefied gas volume into said closure cabinet 3 downstream of the transfer cabinet 4, according to the progress direction of the open containers,
- an action b) of vacuumising the open containers 1 present inside the transfer cabinet 4.

Optionally, and during the action a), it is possible to introduce a little amount of liquefied gas into the container in the closure cabinet. In other words, said action a) of injecting a process gas G flow comprises, besides the injection of a gaseous stream, the injection of an amount of liquefied gas with the vaporisation of the liquefied gas after closure of the container so as to increase the pressure inside the container higher than the pressure prevailing in the closure cabinet.

According to the invention, once closed, the pressure inside the container can thus be controlled, maintained between 1024 millibars and 1224 millibars absolute at 20° C. and as described later on namely at a pressure substantially equal or close to the pressure prevailing in the closure cabinet 3. In such a case, said action a) does not provide for the aforementioned step of injecting an amount of liquefied gas. For some types of containers, in particular some types of metallic tin cans, a pressure inside the containers that is too close to the atmospheric pressure, namely within the range 1024 millibars absolute and 1224 millibars absolute at 20° C. could cause problems of stability of the shape of the cans in particular when the storage temperature of the cans varies within a range from 10° C. to 37° C., with a change in the shape of the can (swelling/contraction) during temperature changes.

The addition of an amount of liquefied gas during the injection action a) enables a considerable overpressure in the container, typically higher than 1424 millibars absolute, and allows solving this can stability problem.

The evacuation of the air present in the open containers 1 is obtained by the combined actions of the vacuum created in said transfer cabinet 4 and the replacement of the evacuated air with the process gas G originating from the closure cabinet and flowing in countercurrent with the open containers in said transfer cabinet 4.

Figure 3:
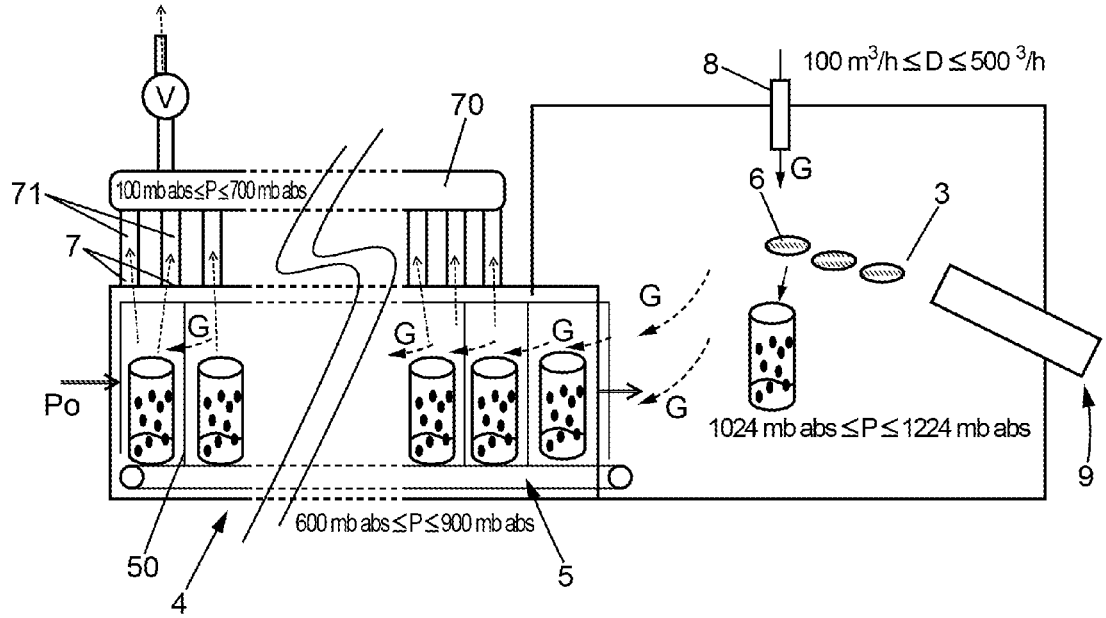
FIG. 3 is a schematic side view of the plant of FIG. 2, illustrating more particularly the combined actions of the vacuum created in the tunnel and the replacement of the evacuated air with the non-oxidising process gas flowing in countercurrent with the open containers in said tunnel, and according to the packaging method according to the invention.

Such a phenomenon is illustrated in FIG. 3: notice that the non-oxidising process gas supplied directly into the closure cabinet 3 (downstream), is sucked in said transfer cabinet 4, by the action of the vacuum created upstream. The process gas is sucked in countercurrent with the open containers 1 circulating along the transfer cabinet 4 in the direction of the closure cabinet 3. In this transfer cabinet 4, the process gas expels the air of the containers which escapes from said containers, this expulsion action being amplified by the vacuum to which the open containers are subjected in said transfer cabinet 4. Thus, the concentration of oxygen in the containers is reduced, which reduction is amplified even more by the effect of dilution of the air oxygen with the process gas which takes place in said transfer cabinet 4, and even in said closure cabinet 3.

As an example:

- the vacuum created in the transfer cabinet 4 at step b) may be comprised between 600 millibars absolute and 900 millibars absolute, in particular between 700 millibars absolute and 900 millibars absolute (the measurement being collected at the middle of the transfer cabinet 4, according to the progress direction of the containers);
- the flow rate of gas injection into the closure cabinet at step a) may be comprised between 100 $m^3/h$ and 500 $m^3/h$ and for example between 200 $m^3/h$ and 300 $m^3/h$, possibly that of liquefied gas (for example liquid nitrogen) between 0.5 ml and 5 ml per container.

According to the observations of the inventors, these two combined actions advantageously allow extracting the air of the containers, namely the air of the head space of the containers (above the products), and where appropriate the interstitial air between the products (beneath the head space), and that being so in a rapid way.

Thus, a reduction of the concentration of oxygen in the containers is achieved, which reduction is amplified by the aforementioned dilution effect. The amount of oxygen in the closed container is comprised between 4.5% and 0.2% of oxygen in volume with respect to the total volume of contained gas (in the head space and the interstitial spaces), strictly lower than 4.5%, for example between 3% and 0.2%, such as between 2% and 0.2%, such as between 1% and 0.2% of oxygen. These reduction performances are achieved even when the interstitial air is present in a non-negligible amount. Thus, the invention finds a particular application in removing air when the products consist of corn in a little bit of juice, with the presence of interstitial air between the corn grains.

According to the invention, it is possible to reduce the residual air to very small amounts and, in contrast with oxygen reduction techniques based only on sweeping with a non-oxidising process gas, or based only on vacuumising the open container before closure, advantageously without any effect on the production rates of the plant which could remain high, typically higher than 100 strokes per minute, in particular higher than 300 strokes per minute, such as 600 strokes per minute, and even more.

Figure 2:
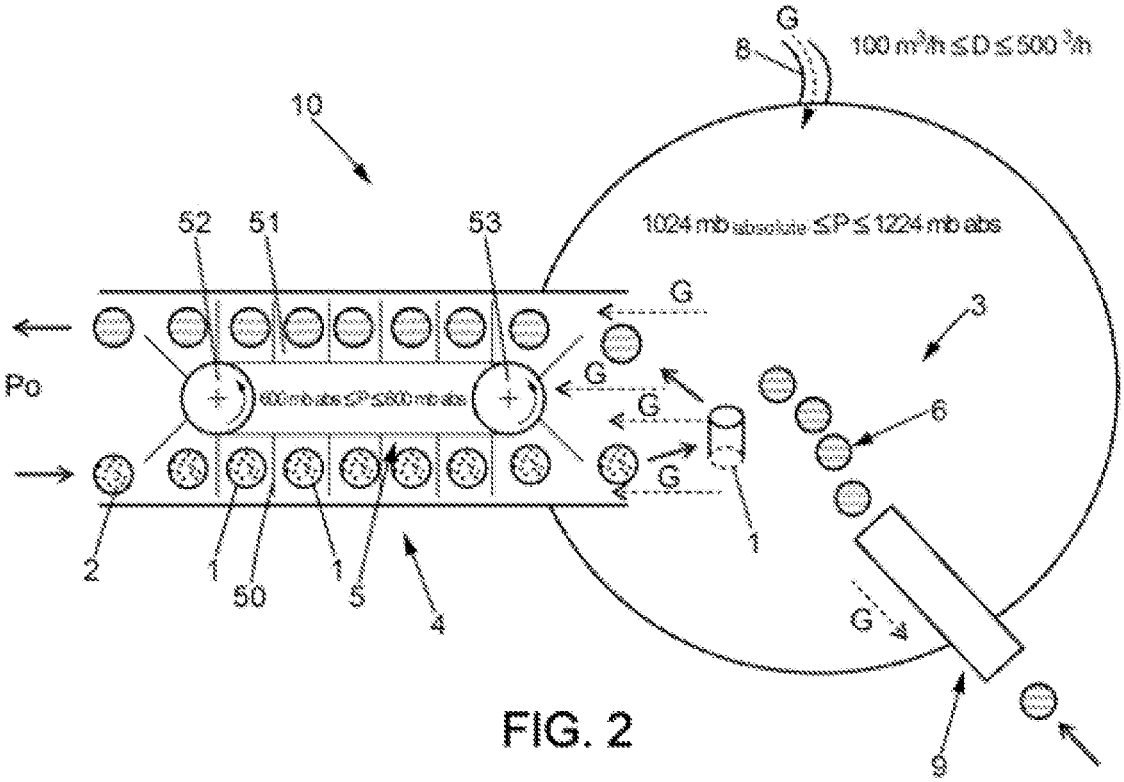
FIG. 2 is a schematic top view of a packaging plant in accordance with the invention that could be obtained by modifying the vacuum seamer of FIG. 1 and for which the transfer cabinet consist of a tunnel containing a conveyor.

According to one embodiment, illustrated in particular in FIGS. 2 and 3, the pressure P inside the closure cabinet 3 may be higher than the atmospheric pressure, close to the atmospheric pressure Po, in particular comprised between 1024 millibars absolute and 1224 millibars absolute, for example between 1024 millibars absolute and 1074 millibars absolute, and for example between 1024 millibars absolute and 1054 millibars absolute.

According to this embodiment, the tight closure of the container is carried out at a pressure close to the atmospheric pressure, and substantially at the pressure in the closure cabinet. Advantageously, it is possible to use containers such as tin cans, even with a small thickness, smaller than 0.14 mm, and even jars made of glass or plastic or flexible containers for the implementation of the method.

Advantageously, it is possible to obtain containers, in particular metallic tin cans, in (controlled) overpressure with respect to the atmospheric pressure, higher than 1024 millibars absolute at 20° C. comprised between 1024 millibars absolute and 1224 millibars absolute, for example between 1054 millibars absolute and 1224 millibars absolute. In the case where the method implements the injection of a liquefied gas at the action a), the pressure inside the container may be higher than 1454 millibars absolute at 20° C.

According to one embodiment, the progress of the open containers 1 in said transfer cabinet 4 is ensured by a conveyor 5 with an air-lock function, which comprises movable shutters 50. These shutters extending between the open containers, during the progress of the containers 1, ensuring a relative tightness to gases. These shutters 50 allow ensuring a certain vacuum level in the transfer cabinet 4, necessary for the implementation of the method.

Such a conveyor 5 is schematically illustrated as example in FIG. 2. It may comprise a flexible belt 51, in the form of a loop, rotatably driven by two rolls 52, 53, each with a vertical axis, disposed at two ends of the tunnel 4. The shutters 50 consist of plates borne at regular intervals by the flexible belt 51.

As the conveyor 5 progresses, the flexible belt is rotatably driven and synchronises the containers 1 circulating in said transfer cabinet 4, in particular the tunnel. On one side of the transfer cabinet 4, the advancing section of the flexible belt accompanies the open containers 1 from the entry of the transfer cabinet 4 at the atmospheric pressure (and under an uncontrolled atmosphere), up to the closure cabinet 3 maintained under a non-oxidising process gas.

Afterwards, the upper openings of the containers are closed, by any suitable means, such as by setting a cap or others. Afterwards, the return section of the flexible belt 51 accompanies the tightly closed containers from the closure cabinet 3 up to the exit of the transfer cabinet 4 under atmospheric pressure.

Alternatively to the conveyor belt, it is possible to use the rotary-type conveyor illustrated in FIG. 1*bis*, and which comprises one or several barrel(s) in series, rotatably synchronised, and each provided with one or several compartment(s) for the containers. In such a rotary conveyor, the containers circulate from one barrel to another, during their rotation, and as known as such from this state of the art.

According to one embodiment, the containers 1 consist of tin cans, the closure of the containers essentially consisting in adding caps 6 and crimping the caps to the containers. In the case of a container with a flexible wall, the closure may be achieved by pinching the walls of the opening and by the application of a weld between the pinched walls.

According to one embodiment (illustrated in a non-limiting manner in FIG. 3), the action b) of vacuumising the open containers present inside the transfer cabinet 4 is carried out by sucking in the atmosphere inside said transfer cabinet 4 at several distinct suction areas 7, distributed along said transfer cabinet 4. In particular, these suction areas are provided over the upper wall of said transfer cabinet 4. In particular, the action b) is carried out by means of a vacuumised dispensing and regulation chamber 70, as well as a plurality of suction pipes 71, parallel to one another joining the dispensing and regulation chamber 70 to said suction areas 7 distributed along said transfer cabinet 4.

This dispensing and regulation chamber is subjected to a vacuum source V, such as a vacuum pump. Afterwards, the dispensing chamber allows distributing the suction evenly at said suction areas 7. The vacuum inside the dispensing and regulation chamber 70 may be comprised between 100 millibars absolute and 700 millibars absolute.

In general, the process gas may consist of nitrogen, or $CO_2$ or another non-oxidising gas, or a mixture of non-oxidising gases.

The invention also relates to a packaging plant 10, as described before, and suited for the implementation of the method according to the invention.

This plant comprises:

- a gas-tight cabinet, called closure cabinet 3,
- a closure system configured so as to close the upper opening of each container, inside said closure cabinet 3,
- a partially tight transfer cabinet 4, opening into the closure cabinet 3, receiving a conveyor 5 with an air-lock function, ensuring the entry of the open containers 1 into the closure cabinet 3, upstream of the closure system and the exit of the closed containers downstream of the closure cabinet 3, said conveyor with an air-lock function comprising movable shutters 50,
- a source of an oxygen-free process gas, such as nitrogen, and a system 8 for injecting said process gas into the closure cabinet 3 and optionally for liquid gas injection,
- a vacuum source V, connected to a dispensing and vacuum regulation chamber 70, as well as a plurality of suction pipes 71 joining the dispensing and regulation chamber 70 to said suction areas 7 distributed along said transfer cabinet 4,
- possibly, a conveyor for bringing in the caps 9 enabling transfer from the atmospheric pressure outside the closure cabinet up to the inside of the closure cabinet.

Advantageously, it is possible to obtain such a packaging plant, in accordance with the invention, by modifying an existing plant such as a vacuum seamer 20, known from the state of the art, and schematically illustrated in FIG. 1 or 1*bis*, and therefore at a lesser installation cost.

Such an existing plant 20, in particular a vacuum seamer 20 with a linear feed-in conveyor known from the start of the art, is schematically illustrated in FIG. 1.

It comprises:

- a gas-tight cabinet, called closure cabinet 3,
- a closure system configured so as to close the upper opening of each container, inside said closure cabinet, typically by crimping a cap,
- a partially tight transfer cabinet 4, such as a tunnel, opening into the closure cabinet 3, receiving a conveyor 5 with an air-lock function, ensuring the entry of the open containers into the closure cabinet, upstream of the closure system and the exit of the closed containers downstream of the closure cabinet, said conveyor with an air-lock function comprising movable shutters 50,
- a vacuum source V connected to said closure cabinet,
- a conveyor for bringing in the caps 9 enabling transfer from the atmospheric pressure (outside the closure cabinet) up to the inside of the closure cabinet.

Such a plant 20 known from the state of the art, typically a vacuum seamer, allows reducing the amount of oxygen in the closure cabinet by vacuumising the closure cabinet, by a vacuum in the range of 800 millibars below the atmospheric pressure (224 millibars absolute).

A first drawback of such a method is that it allows reducing the concentration of air oxygen in the container only through a reduction of the air pressure inside the container upon closure thereof in the closure cabinet: some oxygen is always present in a non-negligible amount in the closed container.

A second drawback of such a method is that it is compatible only with containers whose walls are thick enough to withstand a pressure difference between the inside and the outside of the container, once closed and subjected to the atmospheric pressure.

Advantageously, it is possible to substantially improve the packaging of the products contained by the following modifications operated on such a vacuum seamer 20, namely (FIG. 3):

- addition of a dispensing and vacuum regulation chamber 70, as well as a plurality of suction pipes 71 joining the dispensing and regulation chamber 70 to said suction areas 7 distributed along the transfer cabinet 4, while disconnecting the vacuum source from said closure cabinet and while connecting said vacuum source V to said dispensing and regulation chamber 70,
- addition of a regulated source 8 of an oxygen-free process gas G and connecting it to said closure cabinet 3, and optionally of a liquid nitrogen injection.

It is possible to reduce the residual air to very small amounts, in contrast with what is possible with a vacuum seamer. The method is also improved by the possibility of using, as tin cans, metallic cans with a small wall thickness, namely having a wall thickness smaller than or equal to 0.14 millimetre, for example 0.12 millimetre.

Advantageously, these results are obtained without reducing the production rate of the plant.

Advantageously, the packaging method allows obtaining containers containing oxygen-sensitive products, the product bed having interstitial spaces filled with the process gas with a small amount of residual oxygen. The amount of oxygen in the container may be comprised between 4.5% and 0.2% of oxygen in volume with respect to the total volume of gas contained in the head space and the interstitial spaces, and even between 3% and 0.2%, or between 2% and 0.2%, or between 1% and 0.2%, and thus good performances in terms of residual oxygen even in the presence of interstitial air to be expelled between the products, replaced with the process gas. The pressure inside the container is in overpressure with respect to the atmospheric pressure. It may be comprised between 1024 millibars absolute and 1224 millibars absolute at 20° C., for example between 1054 millibars absolute and 1224 millibars absolute, in particular when the method does not provide for a step of injecting liquefied gas at the action a).

The pressure inside the container may also be higher than the atmospheric pressure, for example higher than 1424 millibars absolute at 20° C. when the method provides for said injection of liquefied gas at the action a). It should be noted that the indicated overpressure is that in the container when the products have not undergone sterilisation.

It should be noted that these (unsterilised) containers are characterised by a low oxygen content and an internal pressure that could be higher than those obtained by packaging methods as known from the state of the art, in particular those implementing a vacuum or a gas sweep which, in both cases, generate a partial vacuum typically comprised between 224 millibars absolute and 824 millibars absolute.

This internal overpressure could promote the implementation of the sterilisation.

The invention also relates to a packaging method according to the invention wherein the container is subjected after closure to a step of sterilisation by heat treatment at a temperature higher than 100° C., for example comprised between 110° C. and 130° C. in particular higher than 122° C.

The sterilisation may be achieved on a sterilisation apparatus operating continuously, or in a discontinuous manner.

This method (with the sterilisation step) allows obtaining a sterilised container, the product bed having interstitial spaces filled with the process gas with a small amount of residual oxygen. The amount of oxygen in the container is comprised between 4.5% to 0.2% of oxygen in volume with respect to the total volume of gas contained in the head space and the interstitial spaces, strictly lower than 4.5%, in particular comprised between 3% and 0.2%, or between 2% and 0.2%, or between 1% and 0.2%. The pressure inside the container is in overpressure with respect to the atmospheric pressure, higher than 1024 millibars absolute at 20° C. The pressure inside the container may be comprised between 1024 millibars absolute and 1424 millibars absolute at 20° C., or between 1124 millibars absolute and 1424 millibars absolute when the method does not provide for the injection of liquefied gas at the action a). In the case of injection of liquefied gas at said action a), the internal pressure may be higher than 1424 millibars absolute at 20° C. According to an embodiment of the sterilised container, the products consist of corn with the presence of interstices filled with the process gas, the pressure inside the container being comprised between 1124 millibars absolute and 1424 millibars absolute, in particular 1194 millibars absolute at 20° C.

It should be noted that the pressure inside the container could typically be slightly higher in the sterilised container than in the unsterilised container, at the same temperature (for example 20° C.) because of a possible degassing of the products (when these are not bleached beforehand) during the heat treatment. For example and when the products consist of corn, the sterilisation causes a degassing increasing the pressure inside the closed container. Conversely, in the case of products that are bleached beforehand such as green beans, the sterilisation does not cause a substantial degassing during the sterilisation because the products have already been degassed upon bleaching, before sterilisation.

The invention finds a particular application when the ratio of interstitial spaces in the product bed filled with the process gas, called porosity degree, is comprised between 20% and 60% and, for example between 30% and 40%.

The porosity degree $t_P$ is calculated according to the following formula $$t_p = \frac{D - D'}{D} \times 100 \quad \text{[Math. 1]}$$

With:

- D: the actual density of the product (for example corn) which is expressed by the ratio between the mass of a determined volume of this product and the mass of the same volume of water
- D': the apparent volumetric mass, often called apparent density, namely the ratio of all of the considered products, and the overall volume (including the interstices) that they occupy.

For corn in grains, the porosity degree $t_P$ is conventionally in the range of 42%, and quite often comprised between 41% and 43% depending on the batches.

For (extra fine) peas, the porosity degree $t_P$ is in the range of 34%, and quite often comprised between 33% and 35% depending on the batches.

Figure 4:
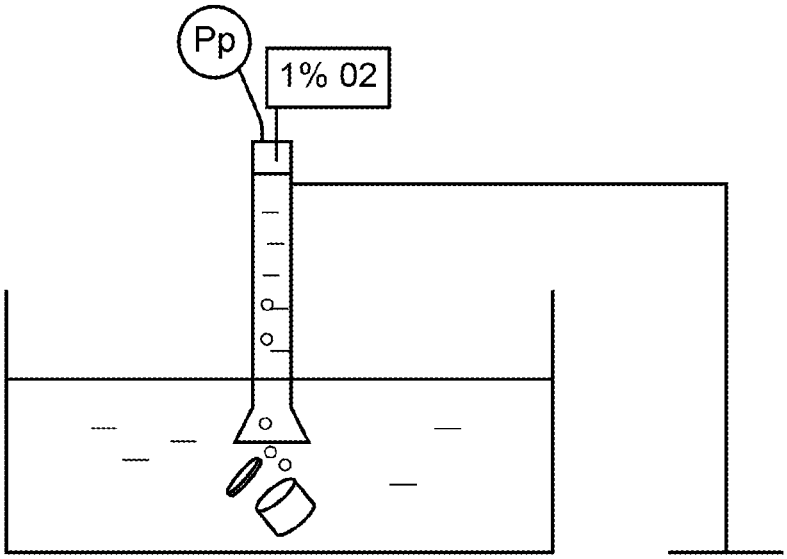
FIG. 4 is a schematic view of a piece of equipment enabling the measurement of the oxygen level in the total volume of gas contained in the head space and the interstitial spaces of a container.

The measurement method used to measure the oxygen level in the closed container, obtained according to the method of the invention uses the equipment illustrated in FIG. 4 which comprises:

- a container filled with water, and large enough to enable handling,
- a volume-graduated column featuring at one end a flared collar, intended to be immersed in water of the container and at its other upper end a tight double connection enabling fitting of a pump Pp and of a calibrated oximeter (Dansensor® Checkpoint 3) equipped with a needle for the determination of the gaseous oxygen percentage.

The measurement protocol is as follows. The container is filled beforehand with water, the graduated column is then turned over the container, its collar being immersed. Pumping starts, air is replaced with water whose level rises until expelling all of the air present in the column.

The container (in particular the tin can) whose oxygen percentage in volume is to be determined is then placed under the flared collar, and then open so as to collect all of the contained total gas volume (head and interstitial space). The released gas expels water from the column, reading of its graduation allows determining the total gas volume that was contained.

The needle of the oximeter is inserted via the tight fitting into the gaseous environment to determine the oxygen percentage thereof.

Tests have been carried out using a modified vacuum seamer according to the invention and with the following conditions:

- flow rate of injection into the closure cabinet: 280 $m^3$/h,
- pressure in the closure cabinet: 1074 millibars absolute,
- pressure in the transfer cabinet: 750 millibars absolute (at the middle thereof according to the progress direction of the containers).

The products consist of corn, featuring a porosity degree of 42%.

The used containers consist of tin cans in the ¼ format (70 mm height and 65 mm diameter). These containers have been packaged according to the method according to the invention, by expelling oxygen contained in the head space and in the interstitial space by the combined actions of a nitrogen stream originating from the closure cabinet 3 and the action of vacuum in the transfer cabinet 4. These tin cans have been tested immediately after crimping by measuring the residual oxygen according to the aforementioned protocol.

Table 1 hereinbelow summarises the obtained results.

TABLE 1

| Cans | tp | Internal pressure (mbs abs) at 20° C. | Residual oxygen |
|---|---|---|---|
| 1 | 42% | 1074 | 0.2% |
| 2 | 42% | 1074 | 0.6% |
| 3 | −42% | −1074 | 0.4% |

When these cans are sterilised in a sterilised operating continuously at a temperature of 128° C., and then, these cans are cooled again down to a stabilised temperature of 20° C., an increase in the internal pressure by 100 millibars is noticed because of a degassing of (unbleached) corn, the internal pressure reaching 1174 millibars absolute.

The invention claimed is:

1. A method for packaging oxygen-sensitive products in containers, each of said containers having upper openings, said method comprising the following steps:

providing a packaging plant comprising:

- a closure cabinet, said closure cabinet configured to be gas-tight,
- a closure system configured to close the upper opening of each container inside said closure cabinet,
- a partially tight transfer cabinet opening into the closure cabinet and having a conveyor with an air-lock function, configured to ensure entry of the containers, which are opened, upstream from the closure cabinet into the closure cabinet and to ensure exit of containers, which are closed, downstream from the closure cabinet, said conveyor with the air-lock function comprising movable shutters configured to extend between the containers to ensure progress of the containers,
- a source of an oxygen-free process gas,
- a system for injecting said process gas into the closure cabinet,
- a vacuum source, connected to a dispensing and vacuum regulation chamber and to a plurality of suction pipes joining the dispensing and regulation chamber to said suction areas distributed along said transfer cabinet, configured to vacuumize the transfer cabinet;

filling partially the containers with products, the containers partially filled with the products having a head space filled with air;

conveying in the transfer cabinet the containers partially filled with the products and having said head space filled with air, and ensuring entry of the containers, which are opened, into the closure cabinet;

closing the containers in the closure cabinet;

setting up a controlled atmosphere inside of the transfer cabinet through which the containers, which are opened, progress in a direction of the closure cabinet, by the following combined actions:

a) injecting a process gas flow into said closure cabinet downstream of the transfer cabinet according to the progress direction of the open containers, and b) vacuumizing the containers that are opened and present inside the transfer cabinet, by implementing suction in the atmosphere inside said transfer cabinet by said suction pipes at several suction areas distributed along said transfer cabinet, said combined actions creating a vacuum in said transfer cabinet and causing the process gas to flow counter current with the conveyed open containers in said transfer cabinet; and evacuating the air present in the containers and reducing the concentration of oxygen in the containers by the combined actions of the vacuum created in said transfer cabinet and a replacement of the evacuated air with the process gas flowing in counter_current with the containers, which are opened, that are conveyed in said transfer cabinet, and by an effect of dilution of the air oxygen with the process gas.

2. The method according to claim 1, wherein said action a) of injecting a process gas flow further comprises, in addition to the injection of a gaseous stream, an injection of an amount of liquefied gas, with the vaporisation of the liquefied gas after closure of the container so as to increase the pressure inside the container above the pressure prevailing in the closure cabinet.

3. The method according to claim 1, wherein a pressure P inside the closure cabinet is higher than an atmospheric pressure Po outside the closure cabinet comprised between 1024 millibars absolute and 1224 millibars absolute.

4. The method according to claim 1, wherein the vacuum created in the transfer cabinet is comprised between 600 millibars absolute and 900 millibars absolute, at a middle of the transfer cabinet.

5. The method according to claim 1, wherein a flow rate of gas injection into the closure cabinet is comprised between 100 $m^3/h$ and 500 $m^3/h$.

6. The method according to claim 1, wherein the containers consist of metallic tin cans, closure of the containers essentially consisting in adding caps and crimping the caps to the containers.

7. The method according to claim 1, wherein the containers consist of flexible containers, and/or the containers consist of rigid containers made of plastic or of jar-type glass.

8. The method according to claim 1, featuring interstitial spaces between the products filled with the process gas, once the container is closed.

9. The method according to claim 8, featuring the head space between the products and the upper portion of the container filled with the process gas, once the container is closed, and wherein an amount of oxygen in the closed container is comprised between 4.5% and 0.2% of oxygen in volume with respect to a total volume of gas contained in the head space and the interstitial spaces, strictly lower than 4.5%.

10. The method according to claim 1, featuring said head space between the products and the upper portion of the container filled with the process gas, once the container is closed.

11. The method according to claim 1, wherein the process gas is nitrogen, and/or $CO_2$.

12. The method according to claim 1, wherein the pressure (P) inside the closure cabinet is higher than the atmospheric pressure thereby obtaining containers overpressurised with respect to the atmospheric pressure.

13. The method according to claim 12, wherein a pressure inside the containers is higher than 1024 millibars absolute at 20° C. comprised between 1024 millibars absolute and 1224 millibars absolute.

14. The method according to claim 12, wherein the pressure inside the containers is higher than 1424 millibars absolute at 20° C. when said action a) provides for the injection of an amount of liquefied gas, substantially higher than the pressure prevailing in the closure cabinet.

15. The packaging method according to claim 1, wherein the container is subjected after closure to a step of sterilisation by heat treatment at a temperature higher than 100° C.

16. A packaging plant adapted for the implementation of the method according to claim 1 comprising:

a gas-tight cabinet, called closure cabinet, a closure system configured so as to close the upper opening of each container, inside said closure cabinet, a partially tight transfer cabinet, opening into the closure cabinet, receiving a conveyor with an air-lock function, ensuring the entry of the open containers into the closure cabinet, upstream of the closure system and the exit of the closed containers downstream of the closure cabinet, said conveyor with an air-lock function comprising movable shutters that are synchronised with the conveyor, optionally, a conveyor for bringing in the caps enabling transfer from an atmospheric pressure outside the closure cabinet up to the inside of the closure cabinet, a source of an oxygen-free process gas and a system for injecting said process gas into the closure cabinet, a vacuum source connected to a dispensing and vacuum regulation chamber, as well as a plurality of suction pipes joining the dispensing and regulation chamber to said suction areas distributed along said transfer cabinet, and configured to vacuumize the dispensing and vacuum regulation chamber, and so as to evacuate all or part of the air present in the open containers and to reduce the concentration of oxygen in the containers by the combined actions of the vacuum created in said transfer cabinet and the replacement of the evacuated air with the process gas flowing in counter current with the containers, opened, in said transfer cabinet, and by the effect of dilution of the air oxygen with the process gas.

* * * * *